US008591185B2

(12) United States Patent
Slepski et al.

(10) Patent No.: US 8,591,185 B2
(45) Date of Patent: Nov. 26, 2013

(54) LOW PRESSURE EXHAUST GAS DIFFUSER FOR A STEAM TURBINE

(75) Inventors: Jonathon E. Slepski, Clifton Park, NY (US); Prakash B. Dalsania, Bangalore (IN)

(73) Assignee: General Electric Company, Schenectady, NY (US)

( * ) Notice: Subject to any disclaimer, the term of this patent is extended or adjusted under 35 U.S.C. 154(b) by 403 days.

(21) Appl. No.: 12/947,338

(22) Filed: Nov. 16, 2010

(65) Prior Publication Data

US 2012/0121405 A1 May 17, 2012

(51) Int. Cl.
*F01D 1/00* (2006.01)

(52) U.S. Cl.
USPC ..... 415/207

(58) Field of Classification Search
USPC ..... 415/207, 224.5
See application file for complete search history.

(56) References Cited

U.S. PATENT DOCUMENTS 3,400,911 A * 9/1968 Kojima ..... 60/774
6,382,912 B1 5/2002 Lee et al.
6,533,546 B2 3/2003 Kreitmeier
2009/0191052 A1 7/2009 Haller
2010/0071342 A1 3/2010 Siden et al.

OTHER PUBLICATIONS

Kouichi Ishizaka et al., "CFD Studies of Industrial Gas Turbine Exhaust Diffusers", Proceedings of the International Gas Turbine Congress 2003 Tokyo, Nov. 5-7, 2003, pp. 1-8.

* cited by examiner

*Primary Examiner* — Richard Edgar
(74) *Attorney, Agent, or Firm* — Nixon & Vanderhye, P.C.

(57) ABSTRACT

A diffuser is provided for an exhaust steam housing adjacent a last stage row of buckets fixed to a rotor in a steam turbine, each bucket in the last stage row of buckets having a platform portion and an airfoil portion. The diffuser includes an annular inner diffuser ring and an outer annular diffuser ring defining a flow path for steam exiting the last stage row of buckets in a substantially axial direction at a diffuser inlet and turning substantially ninety degrees to a diffuser outlet. A first portion of the inner annular ring extends in a downstream direction beyond the last stage row of buckets substantially parallel to a center axis of the rotor, the first portion having a length dimension in the downstream direction from a radial center line of the last stage row of buckets in a range of between 0.40 and about 0.70 of a center line radial length from the platform portion to a radially outer tip of any bucket in the last stage row of buckets.

20 Claims, 3 Drawing Sheets

LOW PRESSURE EXHAUST GAS DIFFUSER FOR A STEAM TURBINE

BACKGROUND OF THE INVENTION

This invention relates to steam turbine technology in general, and to an axial-to-radial flow, low pressure, steam turbine exhaust gas diffuser in particular.

A steam turbine low pressure (LP) section typically includes an inlet domain, multiple turbine stages and an exhaust gas diffuser or hood. The exhaust gas diffuser is often mounted at the last row of rotating blades or buckets, and is formed to include an axial flow inlet and a radial flow outlet. One of the main functions of the exhaust hood is to recover static pressure and to guide the exhaust gas flow from the last stage row of buckets into the condenser. Flow diffusion takes place in the initial section of the low pressure diffuser formed by the steam guide and bearing cone, while the remainder of the low pressure hood features collect the gas flow in a chamber and guide it to the condenser. Diffusers are typically designed with respect to optimized turbine performance which may be measured in terms of maximum possible static pressure recovery.

Static pressure recovery of the low pressure exhaust diffuser depends on the Area Ratio formed by steam guide and bearing cone profiles and on the last stage bucket exit profile. Generally, bearing cone profiles are designed with 10-20 degree negative or positive angles at the diffuser inlet adjacent the last stage row of buckets, relative to horizontal (or to the turbine rotor axis). This traditional bearing cone design, however, forms a sharp corner very close to the last stage buckets, which leads to a larger pressure gradient from the bucket inner hub to the radially outer tip. This larger static pressure gradient has negative impact on last stage bucket efficiency as well as on diffuser static pressure recovery.

BRIEF SUMMARY OF THE INVENTION

In a first exemplary but non-limiting embodiment, the invention relates to a diffuser for an exhaust steam housing adjacent a last stage row of buckets fixed to a rotor in a steam turbine, each bucket in the last stage row of buckets having a platform portion and an airfoil portion, the diffuser comprising an annular inner diffuser ring and an outer annular diffuser ring defining a flow path for steam exiting the last stage row of buckets in a substantially axial direction at a diffuser inlet and turning substantially ninety degrees to a diffuser outlet; a first portion of the inner annular ring extending in a downstream direction beyond the last stage row of buckets substantially parallel to a center axis of the rotor, the first portion having a length dimension in the downstream direction from a radial center line of the last stage row of buckets in a range of between 0.40 and about 0.70 of a center line radial length from the platform portion to a radially outer tip of any bucket in the last stage row of buckets.

In another aspect, the invention relates to a diffuser for an exhaust steam housing adjacent a last stage row of buckets fixed to a rotor in a steam turbine, each bucket in the last stage row of buckets having a platform portion and an airfoil portion, the diffuser comprising an annular inner diffuser ring and an outer annular diffuser ring defining a flow path for steam exiting the last stage row of buckets in a substantially axial direction at a diffuser inlet and turning substantially ninety degrees to a diffuser outlet; a first portion of the inner annular ring extending in a downstream direction beyond the last stage row of buckets substantially parallel to a center axis of the rotor; wherein the first portion of the inner annular ring has a length dimension in the downstream direction from a center line of said last stage row of buckets of about 0.60 of a center line radial length from a platform portion to a radially outer tip of any of the buckets in the last stage row of buckets.

In still another aspect, the invention relates to a diffuser for an exhaust steam housing adjacent a last stage row of buckets fixed to a rotor in a steam turbine, each bucket in the last stage row of buckets having a platform portion and an airfoil portion, the diffuser comprising n annular inner diffuser ring and an outer annular diffuser ring defining a flow path for steam exiting the last stage row of buckets in a substantially axial direction at a diffuser inlet and turning substantially ninety degrees to a diffuser outlet; a first portion of the inner annular ring extending in a downstream direction beyond the last stage row of buckets substantially parallel to a center axis of the rotor; wherein the first portion of the inner annular ring has a length dimension in the downstream direction from a center line of said last stage row of buckets in a range of between 0.40 and 0.70 of a center line radial length from a platform portion to a radially outer tip of any of the buckets in the last stage row of buckets having a platform portion and an airfoil portion, the diffuser comprising an annular inner diffuser ring and an outer annular diffuser ring defining a flow path for steam exiting the last stage row of buckets in a substantially axial direction at a diffuser inlet and turning in a substantially radial direction to a diffuser outlet; a first portion of the inner annular ring extending in a downstream direction beyond the last stage row of buckets substantially parallel to a center axis of the rotor; wherein the first portion of said inner annular ring has a length dimension in the downstream direction from a center line of the last stage row of buckets in a range of between 0.40 and about 0.70 of a center line radial length from a platform portion to a radially outer tip of any of the buckets in the last stage row of buckets, wherein the center line length is in a range of between about 20 and about 70 inches, and wherein a second portion of the inner annular ring extends at a positive angle of between about 25 and 30 degrees relative to the center axis of the rotor.

The invention will now be described in connection with the drawings identified below.

DETAILED DESCRIPTION OF THE INVENTION

Figure 1:
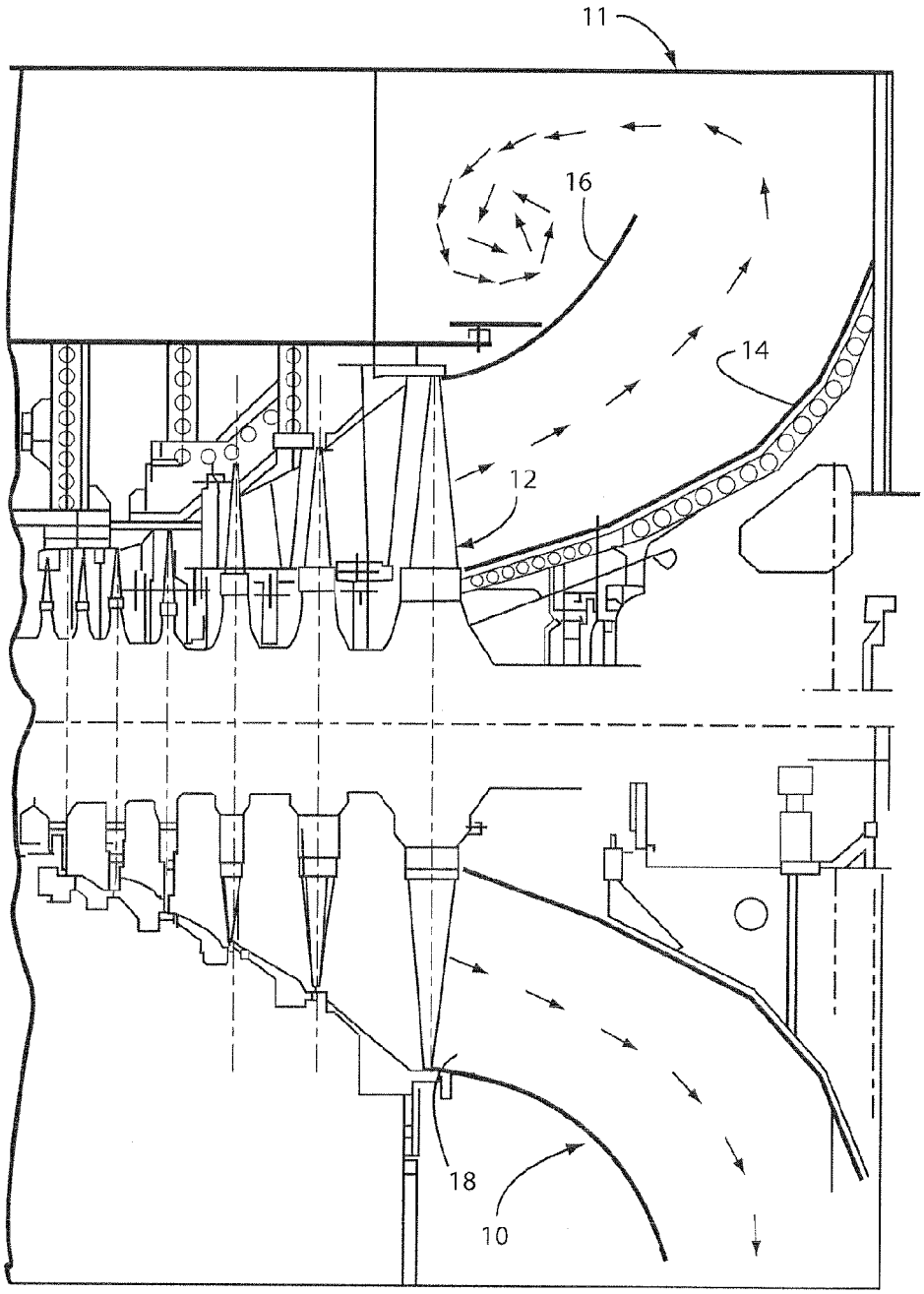
FIG. 1 (PRIOR ART)
FIG. 1 is a side section of a prior turbine exhaust gas diffuser adjacent a last bucket stage.
Figure 2:
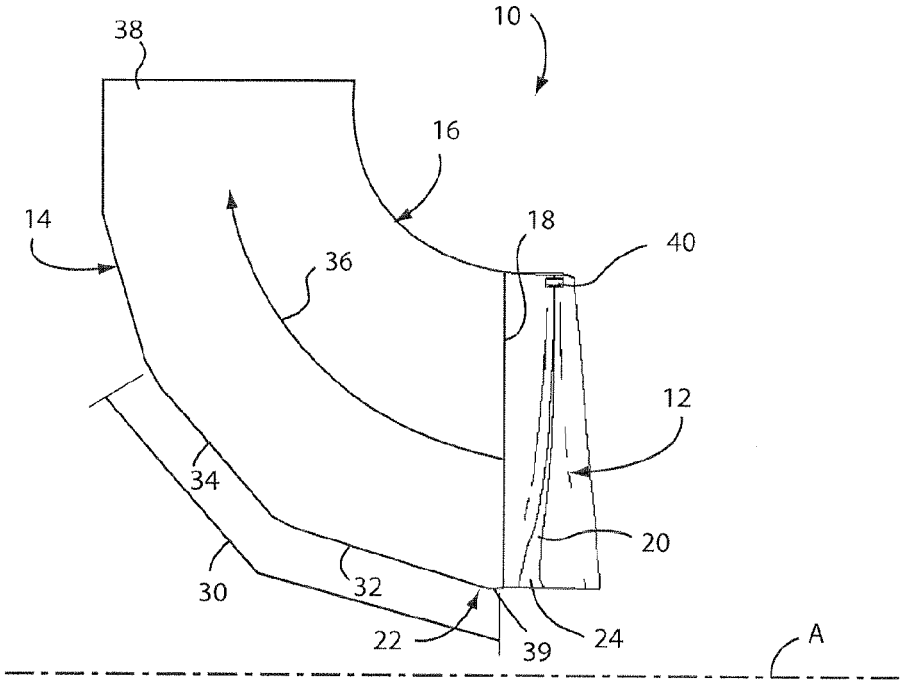
FIG. 2 (PRIOR ART)
FIG. 2 is a simplified schematic cross section through a steam turbine diffuser as shown in FIG. 1.
Figure 3:
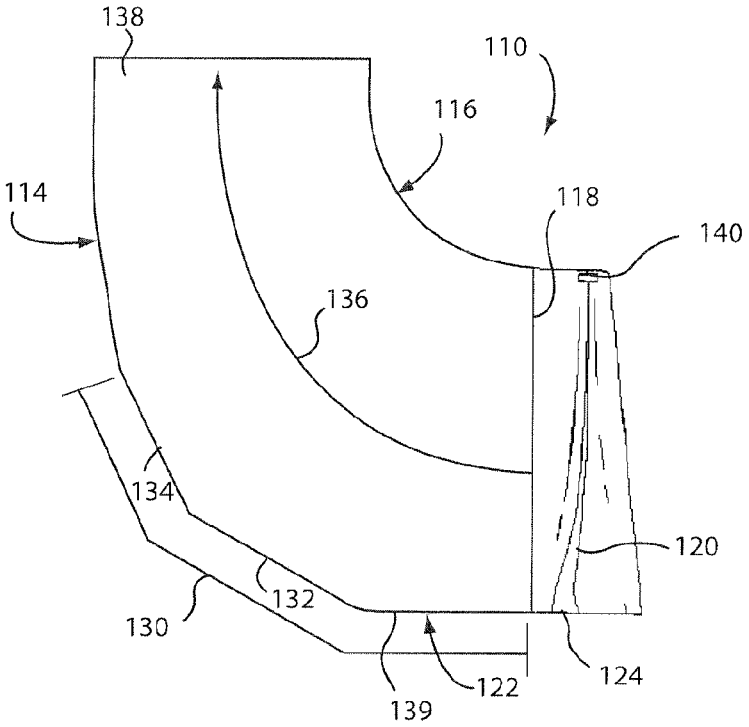
FIG. 3 is a cross section through a steam turbine diffuser in accordance with an exemplary but nonlimiting embodiment of the invention.

With reference to FIG. 1, there is shown a prior turbine exhaust hood or diffuser 10 that may be part of a low pressure steam turbine. The diffuser 10 guides the exhaust flow from the last stage blades or buckets 12 into an exhaust steam housing 11. The diffuser is generally shaped as a hollow toxoid, with only a profile or cross section of the upper portion of the diffuser shown in FIG. 1. The diffuser 10 is formed by an inner ring 14 and an outer ring 16 that are joined to create the hollow toroidal shape, with an inlet to the diffuser 10 at 18, closely adjacent the last row of blades or buckets, represented by the blades 12. FIG. 2 is a simplified schematic of the diffuser 10 that facilitates an understanding of the prior arrangement as compared to the present invention as illustrated in FIG. 3. As best seen in FIG. 2, at the radially inner tip 22 of the inner ring 14, adjacent the hub or platform portion 24 of the blade 20, the diffuser is formed to include a bearing cone area 30 which encompasses that portion of the diffuser extending from the inlet 18 at least through the first and second bends 32, 34, respectively. The annular inner ring 14 and an outer annular ring 16 define a flow path 36 for steam exiting the last stage row of blades or buckets. The flow path extends initially in a substantially axial direction at the last stage 12 and then turns substantially ninety degrees, terminating at the diffuser outlet 38. A flat portion 39 of the inner annular ring 14 at the radially inner tip 22 extends in a downstream direction for only a very short distance, i.e. 0.20 of a center line radial length from the bucket platform or hub 24 to the radially outer tip 40 of the blade or bucket 12. This flat portion of the bearing cone profile is immediately followed by a first positive bearing cone angle of typically 15-20° at bend 32.

Because this traditional design forms a sharp corner very close to the last stage row of buckets 20, a larger pressure gradient is established from the bucket hub or platform 24 to the radially outer tip 40. This larger pressure gradient negatively impacts last stage bucket efficiency as well as diffuser static pressure recovery.

Turning to FIG. 3, in one exemplary but nonlimiting embodiment of the invention, an exhaust hood or diffuser is shown with the same reference numerals used to designate corresponding areas of the diffuser, but with the prefix "1" added. In this example embodiment, the flat portion 139 at the inner tip 122 of the annular ring 114 has an axial length dimension in the downstream direction from a radial center line of the last stage row of buckets 120 in a range of at least (and preferably greater than) 0.40 to about 0.70 of the center line radial length from the platform 124 to the radially outer tip 140 of a last stage bucket 120. The center line radial length of buckets used in the last stage of a steam turbine may be in the range of about 20-70 inches, and may include radial lengths of about 33.5 inches, about 42 inches and about 48 inches.

A second portion 132 of the inner annular ring adjacent the flat portion 139 may extend at an angle of between about 10 and 40°, and preferably between 25 and 30° relative to the center axis of the diffuser (or to the rotor axis). A third portion 134 extends at an even greater angle relative to the center axis and, ultimately, the radially outer portion of the inner ring is substantially perpendicular to the diffuser inlet and the center axis of the rotor.

In one specific example, the inner annular ring 114 of the diffuser has a flat portion 139 with an axial length of 0.60 of a center line radial length from the platform 124 to the radially outer tip 140 of a last stage bucket 120 of about 33.5 inches, and a second portion 132 extending at a positive 30 degree angle relative to the flat portion 122 (or relative to the rotor axis).

Figure 4:
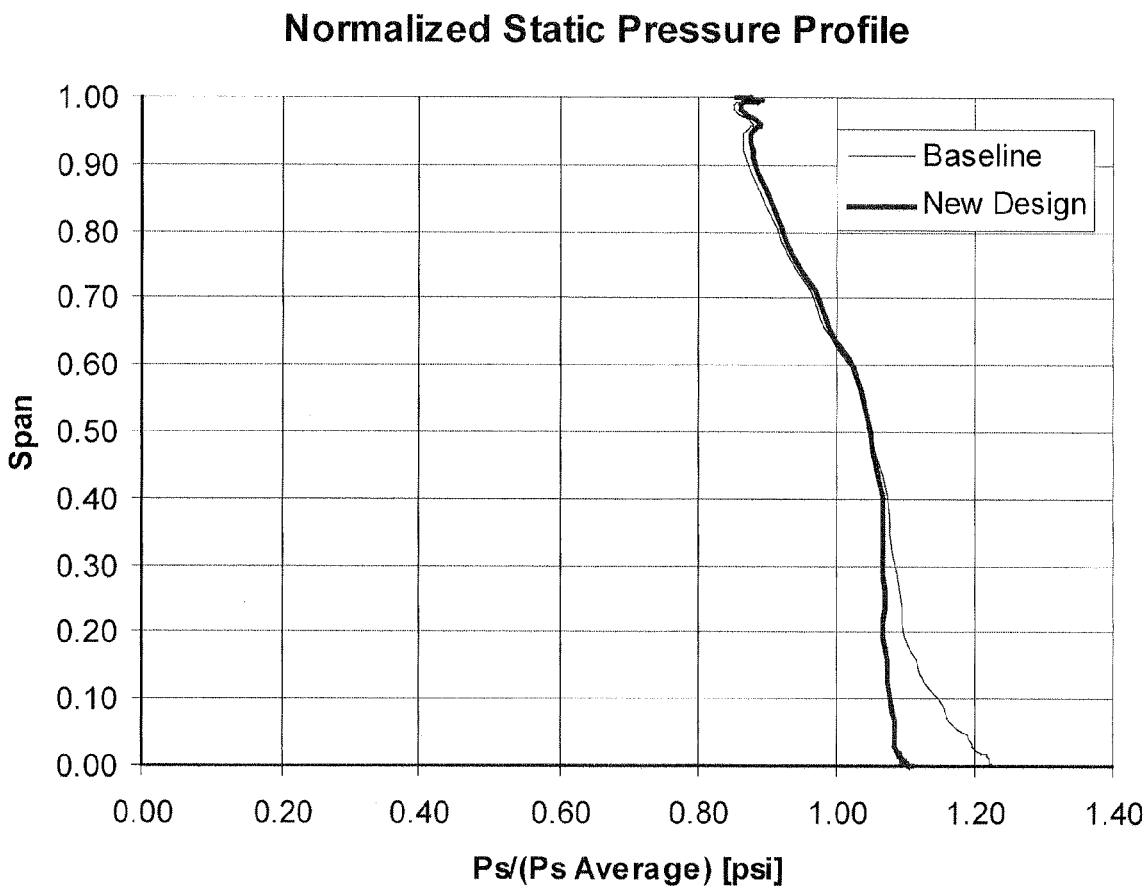
FIG. 4 is a normalized static pressure profile based on coordinates defining the turbine bucket span (length from hub to tip) as a function of average pressure for a "Baseline" diffuser as shown in FIG. 2 and a "New Design" diffuser as shown in FIG. 3.

FIG. 4 illustrates a normalized pressure profile from hub to tip attributable to the diffuser design of FIG. 3. The ideal curve would be a vertical line, and it will be appreciated that the curve representing the pressure profile of the new diffuser design shown is closer to a vertical-line curve than the profile associated with Baseline, or FIG. 1 (and FIG. 2) diffuser design.

The exemplary but nonlimiting embodiments described herein provide for smoother flow of exhaust gas exiting the last stage row of buckets, reducing the pressure gradient from the bucket hub to the bucket tip, while also enhancing static pressure recovery.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A diffuser for an exhaust steam housing adjacent a last stage row of buckets fixed to a rotor in a steam turbine, each bucket in the last stage row of buckets having a platform portion and an airfoil portion, the diffuser comprising:

an annular inner diffuser ring and an outer annular diffuser ring defining a flow path for steam exiting the last stage row of buckets in a substantially axial direction at a diffuser inlet and turning substantially ninety degrees to a diffuser outlet;

a first portion of the inner annular ring extending in a downstream direction beyond said last stage row of buckets substantially parallel to a center axis of the rotor, said first portion having a length dimension in the downstream direction from a radial center line of said last stage row of buckets in a range of between 0.40 and about 0.70 of a center line radial length from the platform portion to a radially outer tip of any bucket in the last stage row of buckets.

2. The diffuser of claim 1 wherein said length dimension is substantially 0.60 of the center line radial length.

3. The diffuser of claim 2 wherein a second portion of said inner annular ring adjacent said first portion extends at an angle of between about 10 and 40 degrees relative to the center axis of the rotor.

4. The diffuser of claim 1 wherein a second portion of said inner annular ring adjacent said first portion extends at a positive angle of between about 10 and 40 degrees relative to the center axis of the rotor.

5. The diffuser of claim 4 wherein said center line radial length lies in a range of between about 20 inches and about 70 inches.

6. The diffuser of claim 4 wherein said angle is between 25 and 30 degrees relative to said center axis of the rotor.

7. The diffuser of claim 1 wherein at said diffuser outlet, said inner annular ring extends substantially perpendicularly to said first portion of said inner annular ring.

8. The diffuser of claim 1 wherein said center line radial length is selected from a group of lengths consisting of about 33.5 inches, about 42 inches and about 48 inches.

9. The diffuser of claim 1 wherein a second portion of said inner annular ring adjacent said first portion extends at an angle of substantially 30 degrees relative to a center axis of the rotor; and said length dimension is substantially 0.60 of the center line radial length.

10. The diffuser of claim 9 wherein said center line radial length is about 33.5 inches.

11. A diffuser for an exhaust steam housing adjacent a last stage row of buckets fixed to a rotor in a steam turbine, each bucket in the last stage row of buckets having a platform portion and an airfoil portion, the diffuser comprising:

an annular inner diffuser ring and an outer annular diffuser ring defining a flow path for steam exiting the last stage row of buckets in a substantially axial direction at a diffuser inlet and turning substantially ninety degrees to a diffuser outlet;

a first portion of the inner annular ring extending in a downstream direction beyond said last stage row of buckets substantially parallel to a center axis of the rotor; wherein said first portion of said inner annular ring has a length dimension in the downstream direction from a center line of said last stage row of buckets of about 0.60 of a center line radial length from a platform portion to a radially outer tip of any of said buckets in the last stage row of buckets, and wherein the center line radial length is selected from a group of lengths consisting of about 33.5 inches, about 42 inches and about 48 inches.

12. The diffuser of claim 11 wherein a second portion of said inner annular ring adjacent said first portion extends at an angle of between about 20 and about 30 degrees relative to a longitudinal axis of the rotor.

13. The diffuser of claim 12 wherein said angle is substantially 25 degrees.

14. The diffuser of claim 13 wherein said center line radial length is 33.5 inches.

15. A diffuser for an exhaust steam housing adjacent a last stage row of buckets fixed to a rotor in a steam turbine, each bucket in the last stage row of buckets having a platform portion and an airfoil portion, the diffuser comprising:

an annular inner diffuser ring and an outer annular diffuser ring defining a flow path for steam exiting the last stage row of buckets in a substantially axial direction at a diffuser inlet and turning in a substantially radial direction to a diffuser outlet;

a first portion of the inner annular ring extending in a downstream direction beyond said last stage row of buckets substantially parallel to a center axis of the rotor; wherein said first portion of said inner annular ring has a length dimension in the downstream direction from a center line of said last stage row of buckets in a range of between 0.40 and about 0.70 of a center line radial length from a platform portion to a radially outer tip of any of said buckets in the last stage row of buckets, wherein said center line length is in a range of between about 20 and about 70 inches, and wherein a second portion of said inner annular ring extends at a positive angle of between about 25 and 30 degrees relative to the center axis of the rotor.

16. The diffuser of claim 15 wherein said length dimensions is substantially 0.60 of the center line length.

17. The diffuser of claim 16 wherein the center line length dimension is selected from a group of lengths consisting of 33.5 inches, 42 inches and 48 inches.

18. The diffuser of claim 17 wherein said positive angle is substantially 30 degrees.

19. The diffuser of claim 18 wherein said center line length is about 33.5 inches.

20. The diffuser of claim 15 wherein the center line length dimension is selected from a group of lengths consisting of 33.5 inches, 42 inches and 48 inches.

* * * * *

UNITED STATES PATENT AND TRADEMARK OFFICE

CERTIFICATE OF CORRECTION

PATENT NO. : 8,591,185 B2
APPLICATION NO. : 12/947338
DATED : November 26, 2013
INVENTOR(S) : Slepski et al.

It is certified that error appears in the above-identified patent and that said Letters Patent is hereby corrected as shown below:

In the Specification

At column 2, line 64, delete “toxoid” and insert --toroid--

Signed and Sealed this
Eleventh Day of February, 2014

Michelle K. Lee

Michelle K. Lee
*Deputy Director of the United States Patent and Trademark Office*